US008110975B2

(12) United States Patent
Liu et al.

(10) Patent No.: US 8,110,975 B2
(45) Date of Patent: Feb. 7, 2012

(54) FIELD EMISSION DISPLAY DEVICE

(75) Inventors: Peng Liu, Beijing (CN); Liang Liu, Beijing (CN); Kai-Li Jiang, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 443 days.

(21) Appl. No.: 12/317,146

(22) Filed: Dec. 19, 2008

(65) Prior Publication Data

US 2009/0160312 A1 Jun. 25, 2009

(30) Foreign Application Priority Data

Dec. 19, 2007 (CN) ..... 2007 1 0125268

(51) Int. Cl.
*H01J 1/62* (2006.01)

(52) U.S. Cl. ..... 313/495; 445/24; 313/311

(58) Field of Classification Search ..... None
See application file for complete search history.

(56) References Cited

U.S. PATENT DOCUMENTS

| | | | | |
|---|---|---|---|---|
| 5,192,240 | A | 3/1993 | Komatsu | |
| 6,011,567 | A | 1/2000 | Nakamura et al. | |
| 7,012,362 | B2 * | 3/2006 | Kawate et al. | 313/495 |
| 7,582,001 | B2 * | 9/2009 | Kitamura et al. | 445/50 |
| 7,739,790 | B2 * | 6/2010 | Shimazu et al. | 313/293 |
| 7,780,496 | B2 * | 8/2010 | Liu et al. | 313/309 |
| 2002/0060516 | A1 | 5/2002 | Kawate et al. | |
| 2005/0188444 | A1 | 8/2005 | Jeong et al. | |
| 2007/0075619 | A1 | 4/2007 | Jiang et al. | |
| 2007/0293115 | A1 | 12/2007 | Gammel et al. | |
| 2009/0195140 | A1 * | 8/2009 | Wei et al. | 313/307 |

FOREIGN PATENT DOCUMENTS

| | | |
|---|---|---|
| CN | 1433039 | 7/2003 |
| CN | 1747102 A | 3/2006 |
| CN | 1790598 | 6/2006 |
| CN | 1941249 A | 4/2007 |
| JP | 2002150924 | 5/2002 |
| JP | 2003288837 | 10/2003 |
| JP | 2005239541 | 9/2005 |
| JP | 2009187945 | 8/2009 |
| TW | I259493 | 8/2006 |
| TW | I277120 | 3/2007 |
| TW | I277124 | 3/2007 |
| TW | M309746 | 4/2007 |
| TW | I283427 | 7/2007 |
| TW | I284340 | 7/2007 |
| TW | I284342 | 7/2007 |

* cited by examiner

*Primary Examiner* — Peter Macchiarolo
(74) *Attorney, Agent, or Firm* — Altis Law Group, Inc.

(57) ABSTRACT

A field emission device includes an insulating substrate, one or more grids located on the insulating substrate. Each grid includes a first, second, third and fourth electrode down-leads and an electron emitting unit. The first, second, third and fourth electrode down-leads are located on the periphery of the grid. The first and the second electrode down-leads are parallel to each other. The third and the fourth electrode down-leads are parallel to each other. The electron emitting unit includes a first electrode, a second electrode and at least one electron emitter. The first electrode is electrically connected to the first electrode down-lead, and the second electrode is electrically connected to the third electrode down-lead. One end of the electron emitter is connected to the second electrode and an opposite end of the electron emitter is spaced from the first electrode by a predetermined distance.

16 Claims, 6 Drawing Sheets

FIELD EMISSION DISPLAY DEVICE

BACKGROUND

1. Technical Field

The invention relates to a display device and, particularly, to a field emission display device.

2. Description of Related Art

Currently, because field emission display (FED) devices provide advantages such as low power consumption, fast response speed and high resolution, they are being actively developed.

Referring to FIG. 6, a conventional FED device 100 according to the prior art includes an insulating substrate 102, a plurality of electrode down-leads 104 arranged in rows, a plurality of electrode down-leads 106 arranged in columns intersecting the rows to form a matrix, and a plurality of electron emitting units 108. The lines 104 are parallel and spaced from each other on the insulating substrate 102. The lines 106 are also parallel and spaced from each other on the insulating substrate 102. The matrix includes a plurality of grids 118 where the electron emitting units 108 are located. A dielectric insulator 105 is disposed at each column and row intersection. Thus, the dielectric insulator 105 is configured to provide electric insulation between the lines 106 and the lines 104.

Each of the electron emitting units 108 includes an electrode 110 extending from a row of the electrode down-lead 104, and an electrode 112 extending from a column of the electrode down-lead 106, and an electron emitter 114. Each electron emitter 114 has an electron emitter region 116 with one or multiple slit(s) provided for emission of electrons. If moderate voltage is applied to the electron emitter 108, electrons will emit from one end of the slit and across to the opposite end of the slit based on the electron tunneling process.

Generally, the electron emitter 114 is a conduction film including a metal compound, e.g. palladium oxide (PdO). However, when such conductive film is applied to a large area FED, current through the electron emitter 114 will be high when the FED operates. Thus, power consumption is high. Furthermore, the activation for each electron emitter 114 is a process with high energy and long time consumption. At the same time, because the slit of the electron emitter region 116 are formed by splitting the conduction film into two parts, it is difficult to precisely form the electron emitter region 116 of the electron emitter 114 based on the present fabricating technology, e.g. shape and location of the electron emitter region are not easy to control. Therefore, every electron emitter 114 will have different electron emission characteristics preventing uniform electron emission.

What is needed, therefore, is an FED device providing low power consumption and improved uniformity of electron emission.

BRIEF DESCRIPTION OF THE DRAWINGS

Many aspects of the present field emission display device can be better understood with reference to the following drawings. The components in the drawings are not necessarily to scale, the emphasis instead being placed upon clearly illustrating the principles of the present field emission display device.

Figure 1:
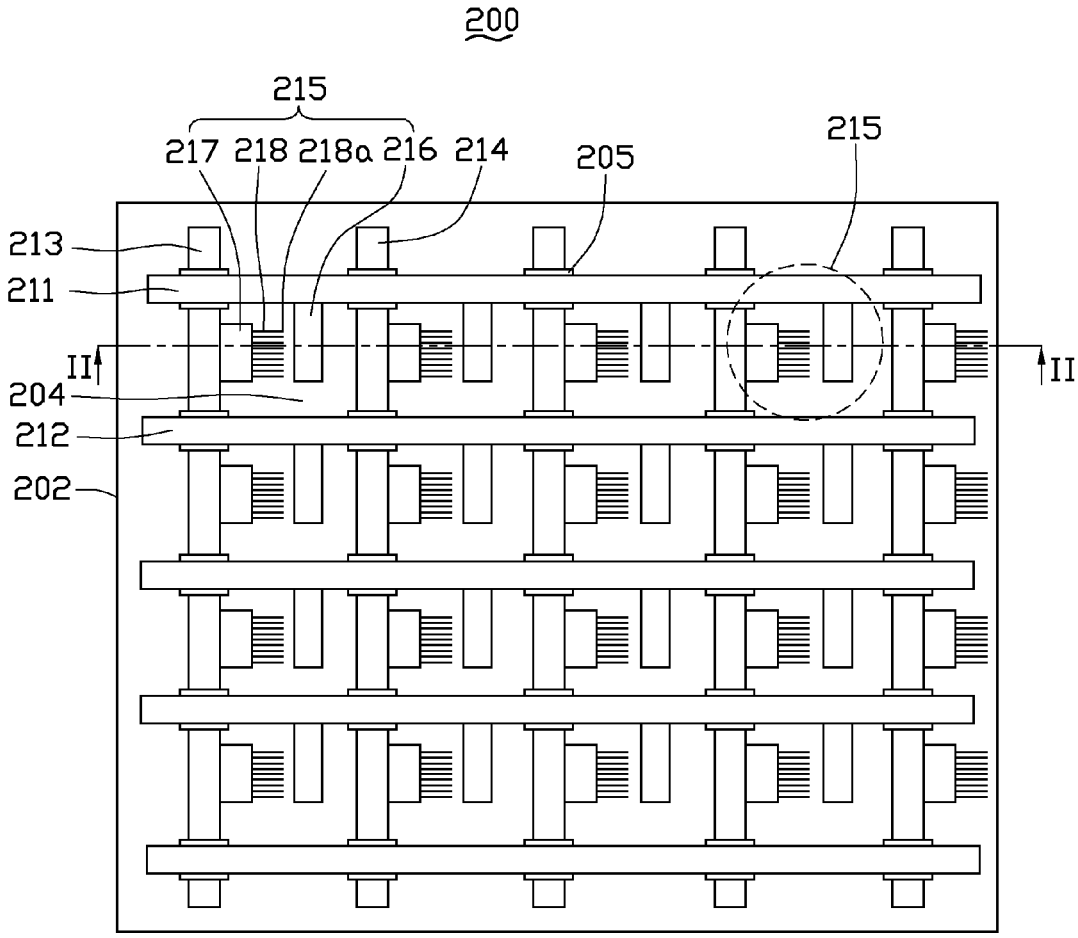
FIG. 1 is a plan view of a field emission display device, in accordance with an illustrated embodiment.

Corresponding reference characters indicate corresponding parts throughout the several views. The exemplifications set out herein illustrate at least one embodiment of the present field emission display device, in one form, and such exemplifications are not to be construed as limiting the scope of the disclosure in any manner.

DETAILED DESCRIPTION OF THE EMBODIMENTS

Reference will now be made to the drawings to describe embodiments of the present field emission display (FED) device, in detail.

Figure 2:
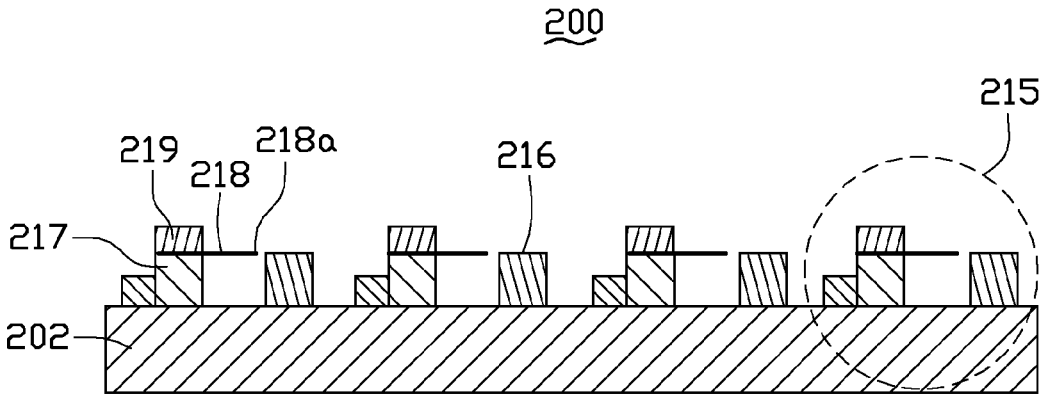
FIG. 2 is a cross sectional view along a broken line II-II of the field emission display device of FIG. 1.

Referring to FIG. 1 and FIG. 2, an FED device 200, according to an exemplary embodiment, is shown. The FED device 200 includes an insulating substrate 202 and one or more grids 204 located thereon.

In the exemplary embodiment, material of the insulating substrate 202 is, for example, ceramics, glass, resins or quartz. In addition, a size and a thickness of the insulating substrate 202 can be chosen according to need. In this embodiment, the insulating substrate 202 is a glass substrate with a thickness of more than 1 mm (millimeter) and an edge length of more than 1 cm (centimeter).

The field emission device 200 of the exemplary embodiment has a plurality of grids 204 arranged in an array. Each grid 204 includes a first electrode down-lead 211, a second electrode down-lead 212, a third electrode down-lead 213, a fourth electrode down-lead 214 and an electrode emitting unit 215. The first, second, third and fourth electrode down-leads 211, 212, 213, 214 are located on the periphery of the grid 204. The first and the second electrode down-leads 211, 212 are parallel to each other. The third and the fourth electrode down-leads 213, 214 are parallel to each other. The first electrode down-lead 211 and the second electrode down-lead 212 cross the third electrode down-lead 213 and the fourth electrode down-lead 214. A suitable orientation of the first, second, third and fourth electrode down-leads 211, 212, 213, 214 is that they be set at an angle with respect to each other. The angle approximately ranges from 10 degrees to 90 degrees. In the present embodiment, the angle is 90 degrees. In addition, a distance between the first electrode down-lead 211 and the second electrode down-lead 212 is in an approximate range from 50 μm to 2 cm. A distance between the third electrode down-lead 213 and the fourth electrode down-lead 214 is in an approximate range from 50 μm to 2 cm.

In the present embodiment, the electrode down-leads 211, 212, 213, 214 are made of conductive material, for example, metal. In practice, the electrode down-leads 211, 212, 213, 214 are formed by applying conductive slurry on the insulating substrate 202 using printing process, e.g. silk screen printing process. The conductive slurry composed of metal powder, glass powder, and binder. For example, the metal powder can be silver powder and the binder can be terpineol or ethyl cellulose (EC). Particularly, the conductive slurry includes 50% to 90% (by weight) of the metal powder, 2% to 10% (by weight) of the glass powder, and 10% to 40% (by weight) of the binder. In the present embodiment, each of the electrode down-leads 211, 212, 213, 214 is formed with a width ranging from 30 μm to 100 μm and with a thickness ranging from 10 μm to 50 μm. However, it is noted that dimensions of each electrode down-lead 211, 212, 213, 214 can vary corresponding to dimension of each grid 204.

Furthermore, the field emission device 200 of the exemplary embodiment can further include a plurality of insulators 205 sandwiched between the first or second electrode down-leads 211, 212 and the third or fourth electrode down-leads 213, 214 to avoid short-circuiting. That is, the insulators 205 are disposed at every intersection of any two electrode down-leads 211, 212, 213, 214 for providing electrical insulation between the electrode down-leads 211, 212 and the electrode down-leads 213, 214. In the present embodiment, the insulator 205 can be a dielectric insulator.

One electrode emitting unit 215 is located in each grid 204. Each electrode emitting unit 215 includes a first electrode 216, a second electrode 217 and at least one electron emitter 218. The first electrode 216 is disposed corresponding to the second electrode 217. In addition, the first electrode 216 spaces apart from the second electrode 217. The electron emitter 218 is disposed between the first electrode 216 and the second electrode 217. In the exemplary embodiment, each electrode emitting unit 215 includes a plurality of electron emitters 218. Moreover, the electron emitters 218 are located over the insulating substrate 202. That is, there is a space between the electron emitters 218 and the insulating substrate 202. The space is provide to enhance the field emission abilities of the electron emitters 218.

The first electrode 216 is connected to the first electrode down-lead 211. The second electrode 217 is connected to the third electrode down-lead 213. The electron emitters 218 are electrically connected to the second electrode 217. That is, referring to FIG. 1, one end of each electron emitter 218 is connected to the second electrode 217. An opposite end of each electron emitter 218 serving as an electron emitting tip 218*a* faces but is spaced from the first electrode 216 by a predetermined distance ranging from 1 μm to 1000 μm.

The first electrodes 216 of the electron emitting units 215 arranged in a row of the grids 204 are electrically connected to the first electrode down-lead 211. In addition, the second electrodes 217 of the electron emitting units 215 arranged in a column of the grids 204 are electrically connected to the third electrode down-lead 213. In the present embodiment, the first electrode 216 serves as a anode and the second electrode 217 serves as an cathode.

In the present embodiment, each of the first electrodes 216 has a length ranging from 20 μm to 1.5 cm, a width ranging from 30 μm to 1 cm and a thickness ranging from 10 μm to 500 μm. Each of the second electrodes 217 has a length ranging from 20 μm to 1.5 cm, a width ranging from 30 μm to 1 cm and a thickness ranging from 10 μm to 500 μm. Usefully, the first electrode 216 has a length ranging from 100 μm to 700 μm, a width ranging from 50 μm to 500 μm and a thickness ranging from 20 μm to 100 μm. The second electrode 217 has a length ranging from 100 μm to 700 μm, a width ranging from 50 μm to 500 μm and a thickness ranging from 20 μm to 100 μm. In addition, the first electrode 216 and the second electrode 217 of the present embodiment are formed by printing the conductive slurry on the insulating substrate 202. As mentioned above, the conductive slurry forming the first electrode 216 and the second electrode 217 is the same as the electrode down-leads 211, 212, 213, 214.

Figure 3:
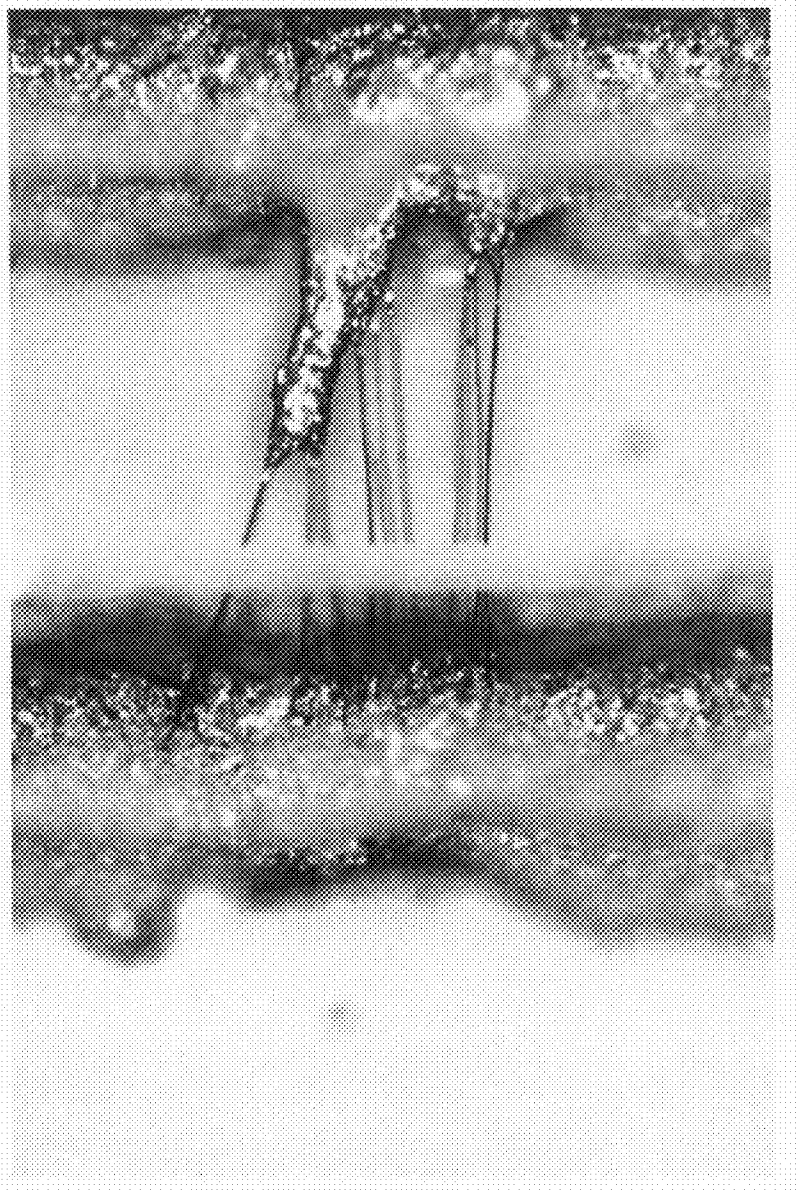
FIG. 3 is a microscope image of an electron emitting unit of the field emission display device of FIG. 1.

In the present embodiment, the electron emitters 218 of each electron emitting unit 215 are arranged in an array. Moreover, the electron emitters 218 are evenly spaced from each other by a distance in the range from 1 μm to 1000 μm. The electron emitter 218 of the present embodiment can be selected from a group consisting of silicon wire, carbon nanotubes, carbon fiber and carbon nanotube yarn. For example, a plurality of carbon nanotube yarns arranged in parallel can be chosen to serve as the electron emitters 218 of the electron emitting unit 215, as shown in FIG. 3. In practice, one end of each carbon nanotube yarn is electrically connected to, for example, the second electrode 217 via a conductive gel. Additionally, the carbon nanotube yarns extend toward the first electrode 216. Thus, an opposite end of each carbon nanotube yarn points toward the first electrode 216 and is spaced from the first electrode 216 by a distance in the range from 1 μm to 1000 μm. The carbon nanotube yarns employed in the present embodiment have lengths ranging from 10 μm to 1 cm. In addition, a distance between adjacent carbon nanotube yarns is in an approximate range from 1 μm to 1000 μm. Each of the carbon nanotube yarns includes a plurality of carbon nanotubes. Specifically, each of the carbon nanotube yarns includes a plurality of carbon nanotube segments, which are joined end to end by van der Waals attractive force. In addition, each of the carbon nanotube segments includes substantially parallel carbon nanotubes. The carbon nanotubes of the present embodiment can be single-walled carbon nanotubes, double-walled carbon nanotubes, or multi-walled carbon nanotubes. A length of each carbon nanotube is in an approximate range from 10 μm to 100 μm and a diameter of each carbon nanotube is less than 15 nm.

Referring to FIG. 2, the FED device 200 of the present embodiment further includes a fixed element 219 disposed on the second electrode 217. The second electrode 217 is configured to fix the electron emitters 218 on the second electrode 217.

Figure 4:
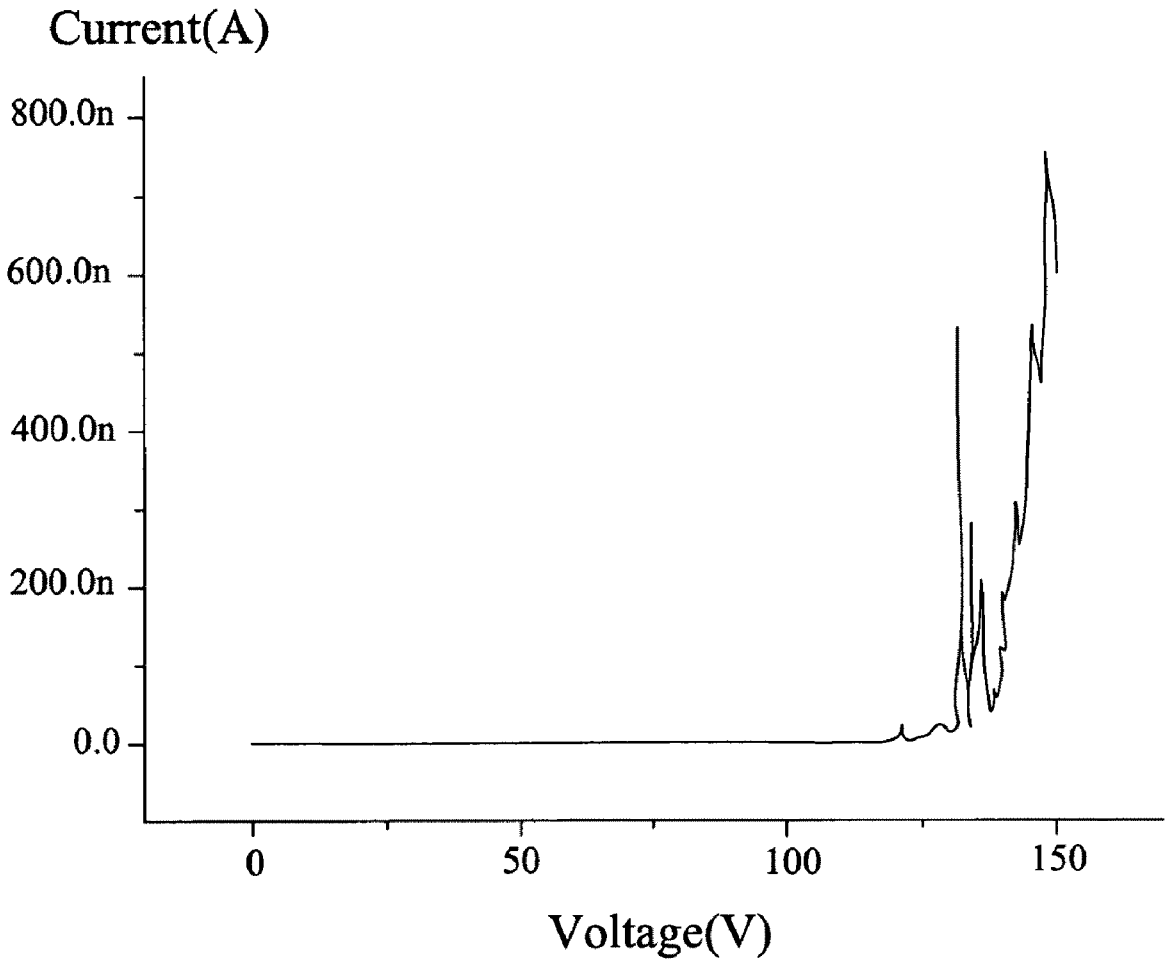
FIG. 4 is a current-voltage (I-V) curve of electrical characteristics of field emission display device of FIG. 1.
Figure 5:
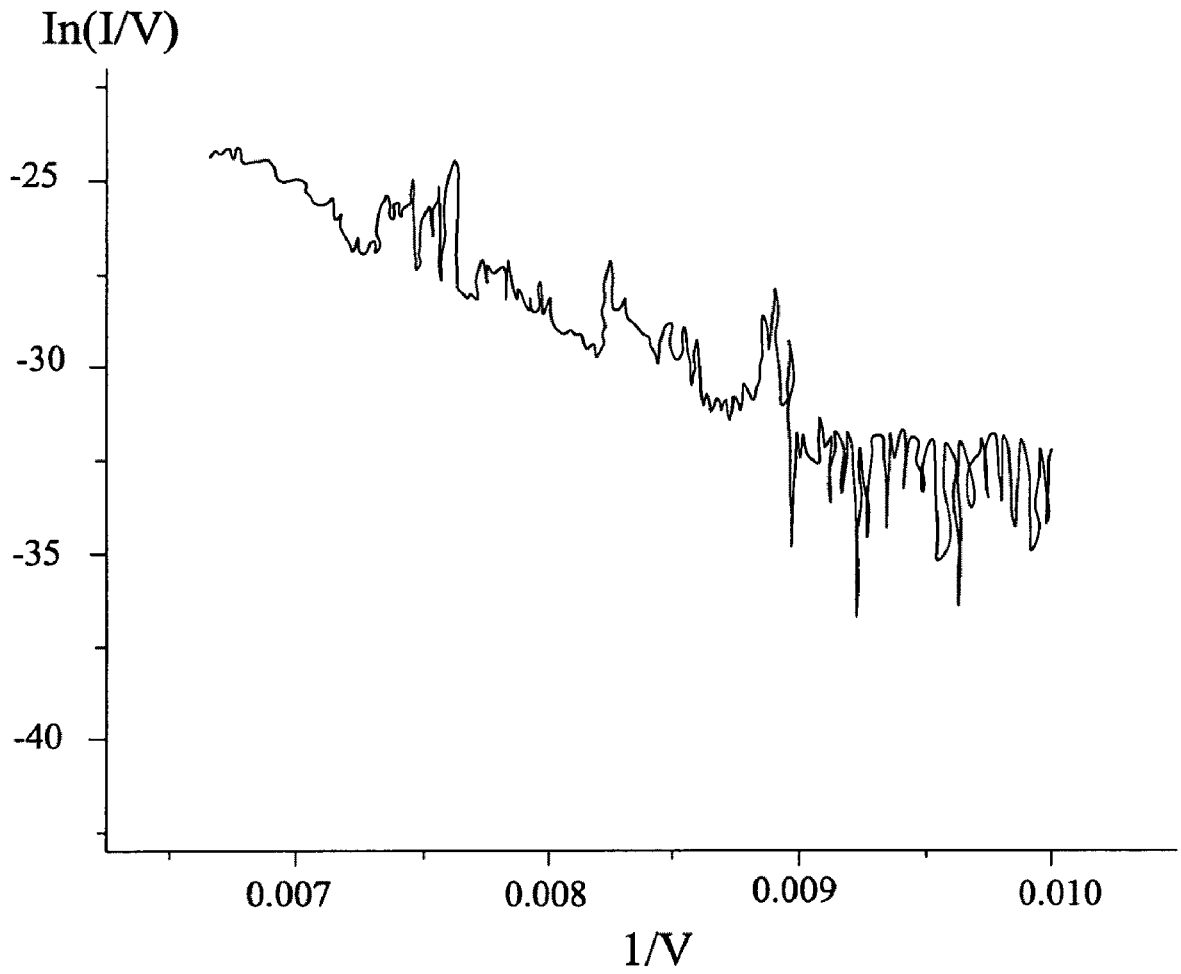
FIG. 5 is Fowler-Nordheim (F-N) curve of electrical characteristics of field emission display device of FIG. 1.
Figure 6:
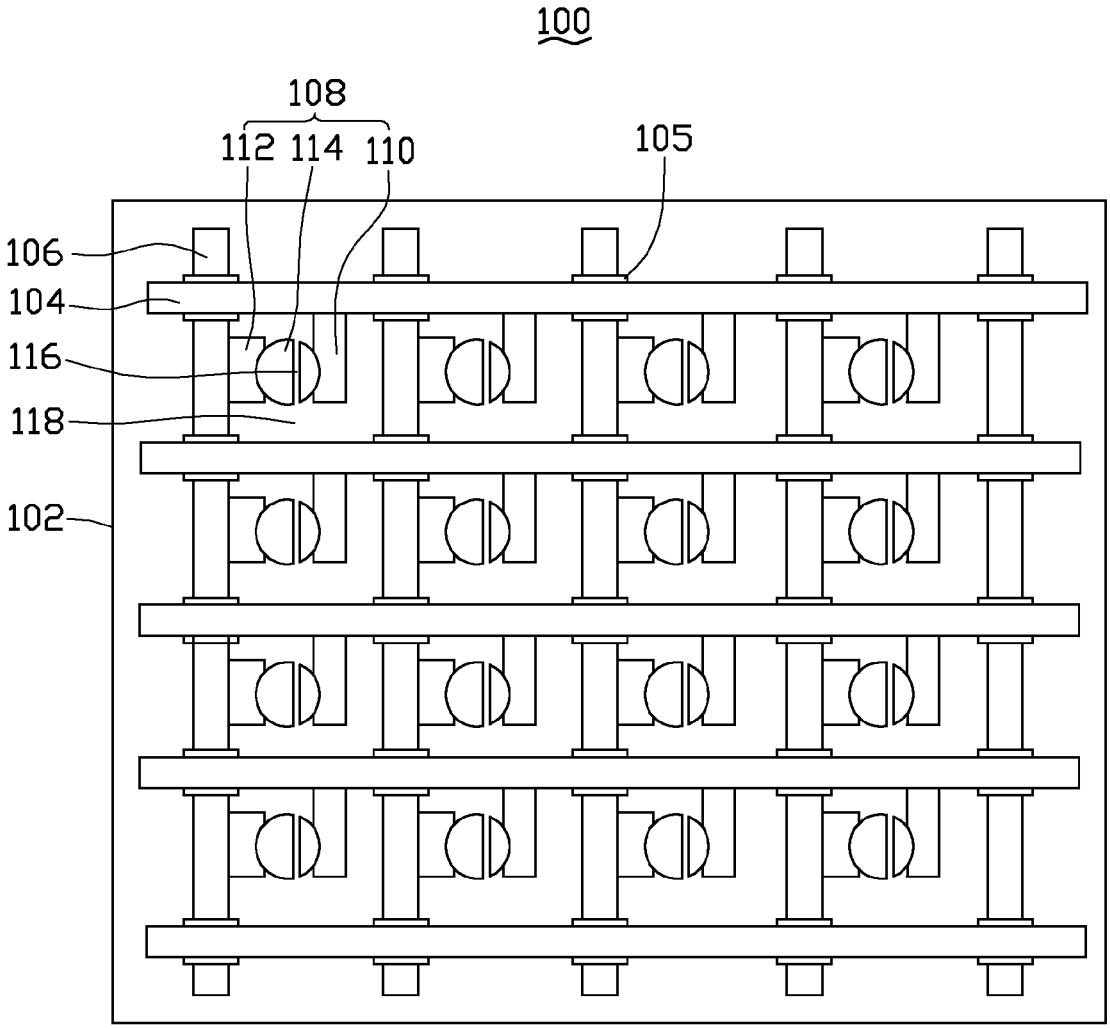
FIG. 6 (RELATED ART)
FIG. 6 is a plan view of a conventional field emission display device according to the prior art.

Referring to FIG. 4, the electrical characteristics of the FED device 200 of the exemplary embodiment is shown. The electrons are emitted from the electron emitters 218 if a voltage of more than 110V is applied to the FED device 200. A current of about 700 nA is generated if the voltage of about 150V is applied to the FED device 200. The power consumption of each electron emitting unit 215 is about 105 μV. Referring to FIG. 5, it shows that the FED device 200 of the exemplary embodiment is performed to have filed emission property.

In conclusion, because a distance exists between the first electrode and the second electrode, no leak current will flow between the two electrodes when the FED device operates. Thus, power consumption of the FED device is reduced. Furthermore, due to even distribution of the electron emitting units, equal distance between each electron emitter and each second electrode, and parallel arrangement of the electron emitters, uniformity of electron emission of the FED device is improved.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A field emission device, comprising:

an insulating substrate; and one or more grids located on the insulating substrate, wherein each grid comprises:

a first, second, third and fourth electrode down-leads located on a periphery of the each grid, the first and the second electrode down-leads being parallel to each other, the third and the fourth electrode down-leads being parallel to each other; and an electron emitting unit comprising a first electrode, a second electrode and at least one electron emitter comprising a plurality of carbon nanotube segments joined end to end by van der Waals attractive force, the first electrode being electrically connected to the first electrode down-lead, and the second electrode being electrically connected to the third electrode down-lead;

wherein one end of each electron emitter is connected to the second electrode, and an opposite end of the each electron emitter is spaced from the first electrode by a predetermined distance.

2. The field emission device as claimed in claim 1, wherein the predetermined distance is in a range from about 1 μm to about 1000 μm.

3. The field emission device as claimed in claim 1, wherein the each electron emitter is located over the insulating substrate.

4. The field emission device as claimed in claim 1, wherein the electron emitting unit-comprises a plurality of electron emitters arranged in an array.

5. The field emission device as claimed in claim 4, wherein a distance between adjacent electron emitters is in an approximate range from 1 μm to 1000 μm.

6. The field emission device as claimed in claim 1, wherein each of the carbon nanotube segments comprises a plurality of carbon nanotubes substantially parallel to each other.

7. The field emission device as claimed in claim 6, wherein a length of each carbon nanotube is in an approximate range from 10 μm to 100 μm.

8. The field emission device as claimed in claim 6, wherein a diameter of each carbon nanotube is less than 15 nm.

9. The field emission device as claimed in claim 1, further comprising a plurality of grids forming an array, wherein the first electrodes of the electron emitting units in a row of the grids are electrically connected to the first electrode down-lead, and the second electrodes of the electron emitting units in a column of the grids are electrically connected to the third electrode down-lead.

10. The field emission device as claimed in claim 1, further comprising a fixed element located on the second electrode.

11. A field emission device, comprising:

an insulating substrate; and at least one grid located on the insulating substrate, wherein each grid comprises:

a first, second, third and fourth electrode down-leads located on a periphery of the each grid, the first and the second electrode down-leads being parallel to each other, the third and the fourth electrode down-leads being parallel to each other, the first and the second down-leads crossing with the third and the fourth electrode down-leads; and an electron emitting unit comprising a first electrode, a second electrode and an electron emitter, the electron emitter comprising a plurality of carbon nanotube segments joined end to end by van der Waals attractive force, the first electrode being electrically connected to the first electrode down-lead, and the second electrode being electrically connected to the third electrode down-lead;

wherein the electron emitter is electrically connected to the second electrode and electrically insulated from the first electrode.

12. The field emission device as claimed in claim 11, wherein the electron emitter extends toward and is spaced from the first electrode.

13. The field emission device as claimed in claim 12, wherein each of the carbon nanotube segments comprises a plurality of carbon nanotubes substantially parallel to each other.

14. A field emission device, comprising:

an insulating substrate; and a grid located on the insulating substrate, wherein the grid comprises:

a first, second, third and fourth electrode down-leads located on a periphery of the grid, the first and the second electrode down-leads being parallel to each other, the third and the fourth electrode down-leads being parallel to each other; and an electron emitting unit comprising a first electrode, a second electrode and a plurality of electron emitters, the plurality of electron emitters comprising a plurality of carbon nanotube yarns located over the insulating substrate, the plurality of carbon nanotube yarns being parallel to each other and each of the plurality of carbon nanotube yarns comprising a plurality of carbon nanotubes, the first electrode being electrically connected to the first electrode down-lead, and the second electrode being electrically connected to the third electrode down-lead;

wherein each of the plurality of electron emitters is electrically connected to the second electrode, and spaced from the first electrode by a predetermined.

15. The field emission device as claimed in claim 14, wherein the plurality of electron emitters are electrically insulated from the first electrode.

16. The field emission device as claimed in claim 15, wherein the carbon nanotubes are joined end to end by van der Waals attractive force.

* * * * *